US007134972B2

(12) United States Patent
Hsu et al.

(10) Patent No.: US 7,134,972 B2
(45) Date of Patent: Nov. 14, 2006

(54) GOLF HEAD

(75) Inventors: Yen-Chi Hsu, Ping-Tung Hsien (TW); Chon-Chen Lin, Ping-Tung Hsien (TW)

(73) Assignee: O-Ta Precision Industry Co., Ltd., Ping-Tung Hsien (TW)

( * ) Notice: Subject to any disclaimer, the term of this patent is extended or adjusted under 35 U.S.C. 154(b) by 9 days.

(21) Appl. No.: 10/863,147

(22) Filed: Jun. 7, 2004

(65) Prior Publication Data

US 2005/0272526 A1 Dec. 8, 2005

(51) Int. Cl.
*A63B 53/04* (2006.01)

(52) U.S. Cl. ..... 473/348; 473/345; 473/347

(58) Field of Classification Search ..... 473/324–350
See application file for complete search history.

(56) References Cited

U.S. PATENT DOCUMENTS

| | | | | |
|---|---|---|---|---|
| 4,545,580 | A * | 10/1985 | Tomita et al. | 473/332 |
| 4,624,460 | A * | 11/1986 | Murase et al. | 473/309 |
| 5,497,993 | A * | 3/1996 | Shan | 473/329 |
| 5,643,108 | A * | 7/1997 | Cheng | 473/329 |
| 6,248,025 | B1 * | 6/2001 | Murphy et al. | 473/324 |
| 6,471,604 | B1 * | 10/2002 | Hocknell et al. | 473/334 |
| 6,849,003 | B1 * | 2/2005 | Kumamoto | 473/305 |

* cited by examiner

*Primary Examiner*—Eugene Kim
*Assistant Examiner*—Alvin A. Hunter, Jr.
(74) *Attorney, Agent, or Firm*—Brinks Hofer Gilson & Lione

(57) ABSTRACT

A golf head includes a hollow head body defining a front opening and having a reinforcing portion that is made from a non-metal material, a striking plate received in the front opening and secured to the head body, and a plurality of first reinforcing metal ribs embedded securely in the reinforcing portion of the head body.

4 Claims, 4 Drawing Sheets

GOLF HEAD

BACKGROUND OF THE INVENTION

1. Field of the Invention

This invention relates to a golf head, more particularly to a golf head with a plurality of reinforcing metal ribs embedded in a non-metal portion of the golf head.

2. Description of the Related Art

Conventional golf heads can be classified into iron head, wood head, and putter head. The body of the wood head is normally made from carbon fiber which tends to deform undesirably after a period of use. In addition, due to a relatively high absorption of sound by the carbon fiber, the striking sound produced by striking a golf ball is too low and is not appealing to the user.

SUMMARY OF THE INVENTION

The object of the present invention is to provide a golf head that is capable of overcoming the aforesaid drawbacks associated with the prior art.

According to this invention, a golf head comprises: a hollow head body defining a front opening and having a reinforcing portion that is made from a non-metal material; a striking plate received in the front opening and secured to the head body; and a plurality of first reinforcing metal ribs embedded securely in the reinforcing portion of the head body.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
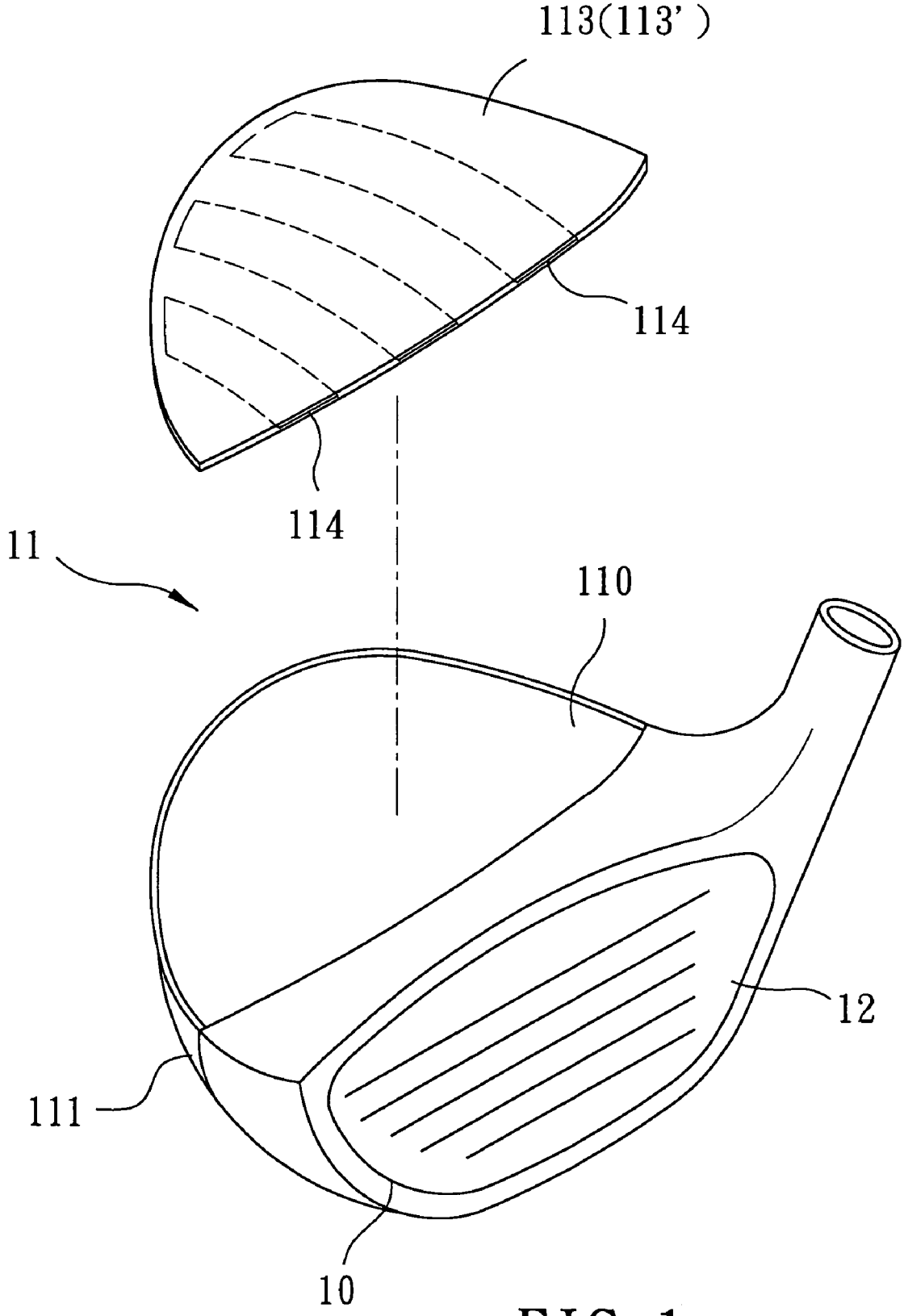
FIG. 1 is a partly exploded perspective view of the first preferred embodiment of a golf head according to this invention.

Before the present invention is described in greater detail, it should be noted that same reference numerals have been used to denote like elements throughout the specification.

Figure 2:
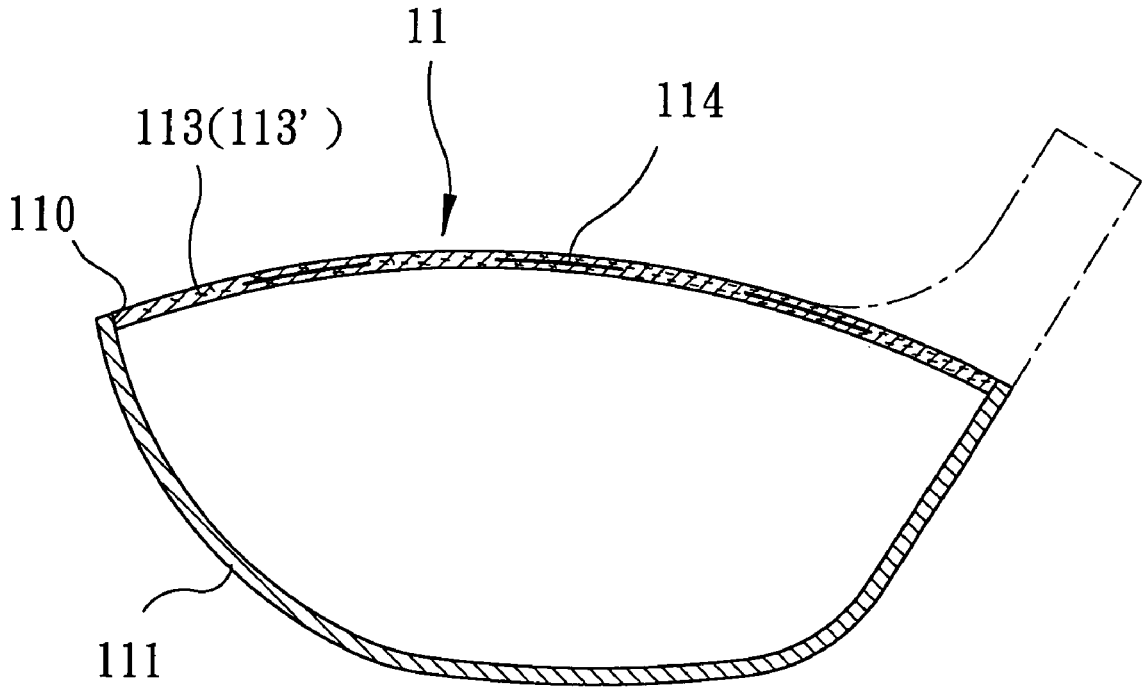
FIG. 2 is a sectional view of the first preferred embodiment of this invention.

FIGS. 1 and 2 illustrate the first preferred embodiment of a golf head according to the present invention.

The golf head includes: a hollow head body 11 defining a front opening 10 and having a reinforcing portion 113 that is made from a non-metal material, such as a composite carbon fiber material; a striking plate 12 received in the front opening 10 and secured to the head body 11; and a plurality of first reinforcing metal ribs 114 embedded securely in the reinforcing portion 113 of the head body 11.

In this embodiment, the head body 11 includes a sole 111 that defines a top opening 110, and a crown plate 113' that is received in the top opening 110, that is secured to the sole 111, and that serves as the reinforcing portion 113 of the head body 11. The first reinforcing metal ribs 114 are parallel to each other, and extend in a transverse direction relative to the striking plate 12.

Figure 3:
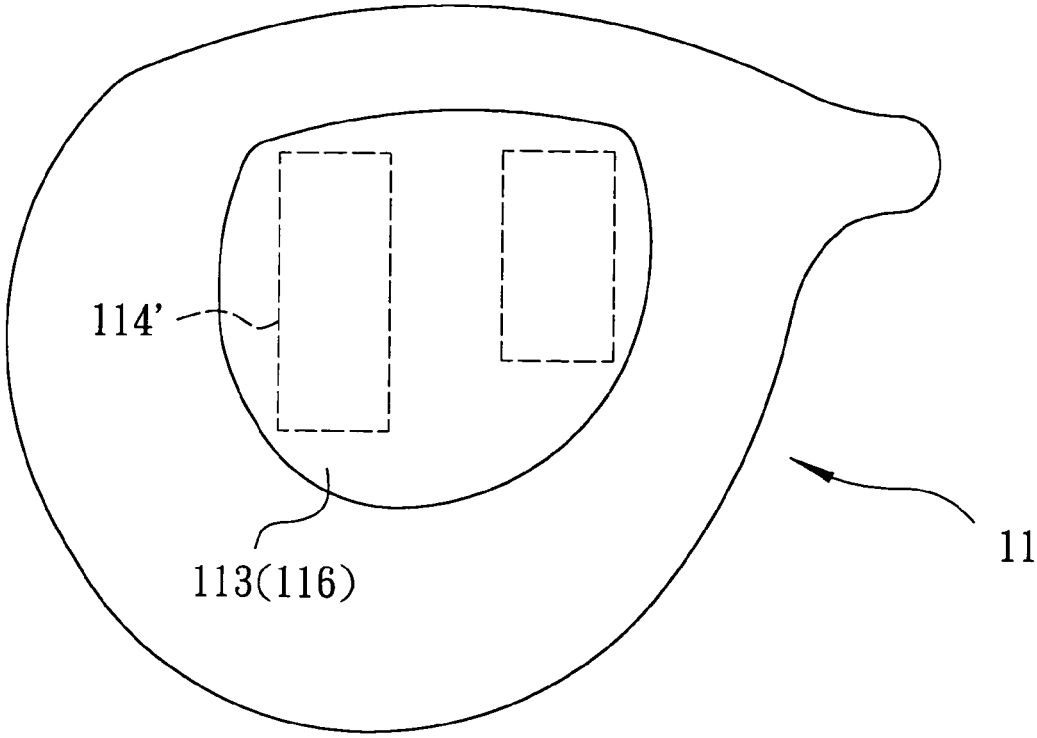
FIG. 3 is a bottom view of the second preferred embodiment of the golf head according to this invention.
Figure 4:
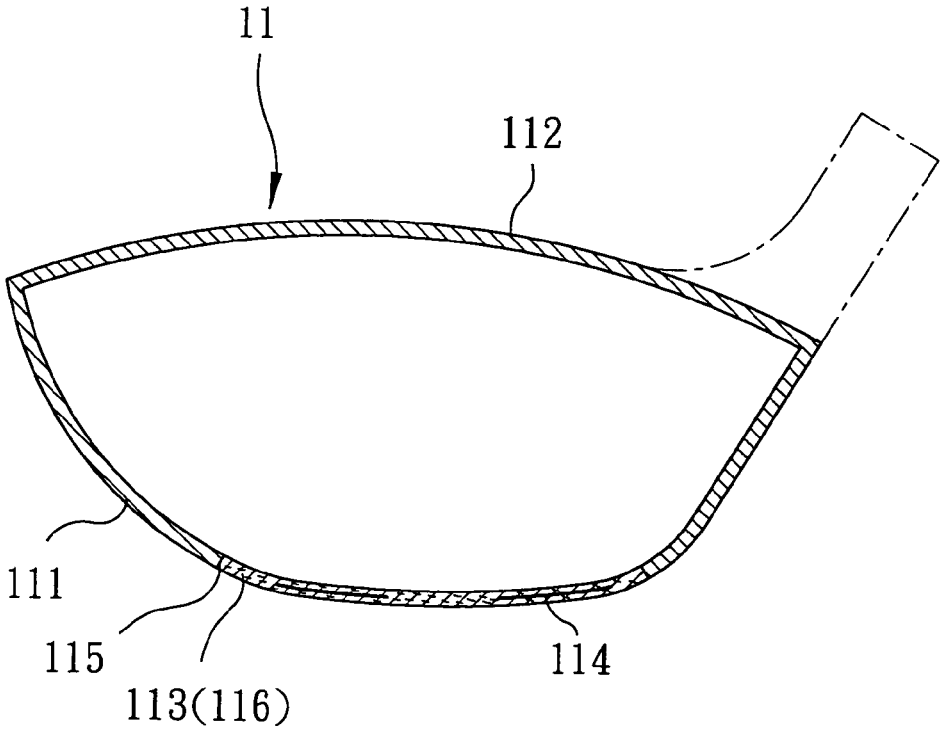
FIG. 4 is a sectional view of the second preferred embodiment of this invention.

FIGS. 3 and 4 illustrate the second preferred embodiment of the golf head according to the present invention. The golf head of this embodiment differs from the previous embodiment in that the head body 11 includes a crown 112, a sole 111 that is integrally formed with the crown 112 and that defines a bottom opening 115 opposite to the crown 112, and a reinforcing plate 116 that is received in the bottom opening 115, that is secured to the sole 111, and that serves as the reinforcing portion 113 of the head body 11. The first reinforcing metal ribs 114 are embedded in the reinforcing plate 116, are parallel to each other, and extend in a transverse direction relative to the striking plate 12.

Figure 5:
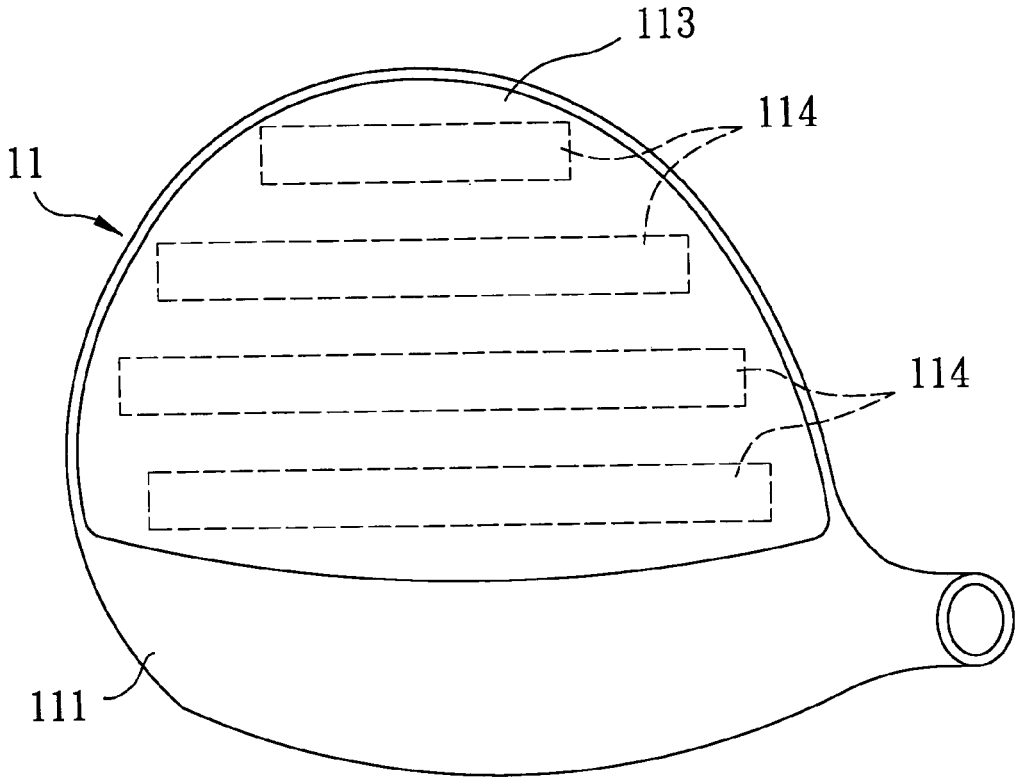
FIG. 5 is a top view of the third preferred embodiment of the golf head according to this invention.
Figure 6:
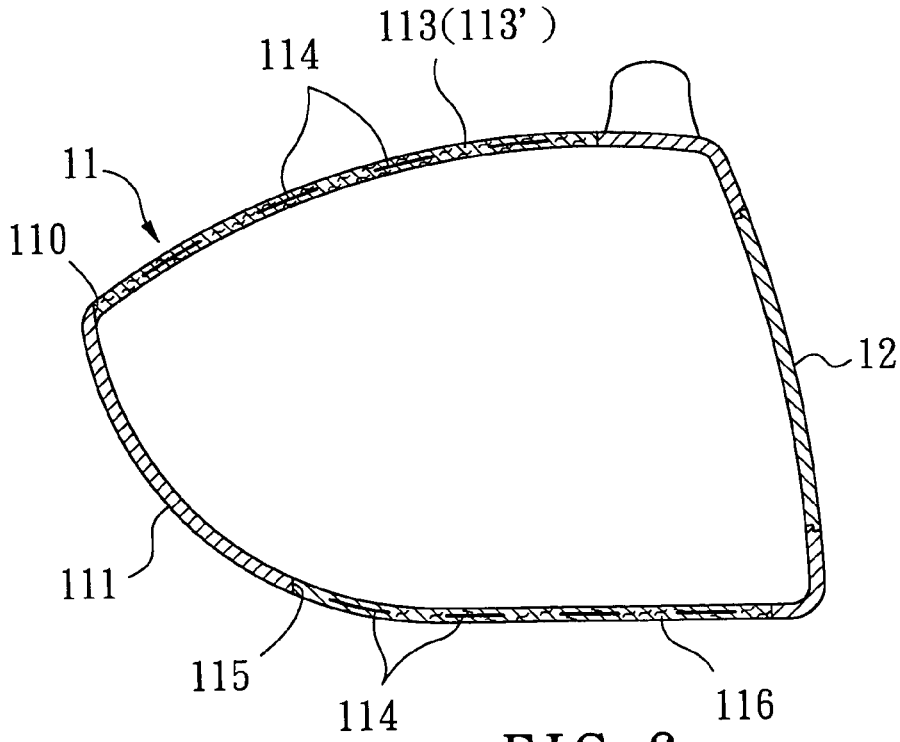
FIG. 6 is a sectional view of the third preferred embodiment of this invention.

FIGS. 5 and 6 illustrate the third preferred embodiment of the golf head according to the present invention. The golf head of this embodiment differs from the previous embodiments in that the head body 11 includes a sole 111 that has opposite top and bottom openings 110, 115, a crown plate 113' that is received in the top opening 110, that is secured to the sole 111, and that serves as the reinforcing portion 113 of the head body 11, and a reinforcing plate 116 that is received in the bottom opening 115, that is secured to the sole 111, and that is made from the non-metal material. The first reinforcing metal ribs 114 are embedded securely in the crown plate 113'. A plurality of second reinforcing metal ribs 114 are embedded securely in the reinforcing plate 116.

In this embodiment, the first and second reinforcing metal ribs 114 are parallel to each other and extend in a parallel direction relative to the striking plate 12.

With the inclusion of the reinforcing metal ribs 114 in the head body 11 of the golf head of this invention, the aforesaid drawbacks associated with the prior art can be eliminated.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A golf head comprising:

a hollow head body defining a front opening and having a reinforcing portion that is made from a non-metal material;

a striking plate received in said front opening and secured to said head body; and a plurality of first reinforcing metal ribs embedded securely in said first reinforcing portion of said head body;

wherein said head body includes a sole that has opposite top and bottom openings, a crown plate that is received in said top opening, that is secured to said sole, and that serves as said reinforcing portion of said head body, and a reinforcing plate that is received in said bottom opening, that is secured to said sole, and that is made from said non-metal material, said golf head further comprising a plurality of second reinforcing metal ribs that are embedded in said reinforcing plate.

2. The golf head of claim 1, wherein said first reinforcing metal ribs are parallel to each other and extend in a parallel direction relative to said striking plate.

3. The golf head of claim 2, wherein said second reinforcing metal ribs are parallel to each other and extend in a parallel direction relative to said striking plate.

4. The golf head of claim 1, wherein said non-metal material is a composite carbon fiber material.

* * * * *